US011774223B2

(12) United States Patent
Hellman

(10) Patent No.: US 11,774,223 B2
(45) Date of Patent: Oct. 3, 2023

(54) FRAGMENTATION DEVICE AND METHOD FIRING SUCH A DEVICE

(71) Applicant: SAAB AB, Linkoeping (SE)

(72) Inventor: Ulf Hellman, Karlskoga (SE)

(73) Assignee: SAAB AB, Linkoeping (SE)

( * ) Notice: Subject to any disclaimer, the term of this patent is extended or adjusted under 35 U.S.C. 154(b) by 107 days.

(21) Appl. No.: 17/439,626

(22) PCT Filed: Mar. 2, 2020

(86) PCT No.: PCT/SE2020/050231
§ 371 (c)(1),
(2) Date: Sep. 15, 2021

(87) PCT Pub. No.: WO2020/190191
PCT Pub. Date: Sep. 24, 2020

(65) Prior Publication Data

US 2022/0170723 A1 Jun. 2, 2022

(30) Foreign Application Priority Data

Mar. 21, 2019 (SE) ..... 1900056-1

(51) Int. Cl.
*F42B 12/32* (2006.01)
*F42B 12/20* (2006.01)
(Continued)

(52) U.S. Cl.
CPC ..... *F42B 12/32* (2013.01); *F42B 12/202* (2013.01); *F42B 12/207* (2013.01); *F42B 12/76* (2013.01); *F42C 19/0838* (2013.01)

(58) Field of Classification Search
CPC ..... F42B 12/32; F42B 12/202; F42B 12/207; F42B 12/76; F42C 19/0838
(Continued)

(56) References Cited

U.S. PATENT DOCUMENTS 4,383,468 A 5/1983 Sie et al.
4,942,820 A * 7/1990 Sawruk ..... F42B 12/76 102/493
(Continued)

FOREIGN PATENT DOCUMENTS

CN 204806988 U 11/2015
DE 2204782 A1 8/1973
(Continued)

OTHER PUBLICATIONS

Swedish Patent and Registration Office, Search Report and Written Opinion received for Application No. SE 1900056-1, dated Oct. 7, 2019, 9 pages, Sweden.
(Continued)

*Primary Examiner* — Samir Abdosh
(74) *Attorney, Agent, or Firm* — ALSTON & BIRD LLP

(57) ABSTRACT

The present invention relates to a substantially spheroidal fragmentation device (10). The fragmentation device (10) comprises: i) a protective exterior layer (6) of resilient material accommodating at least one warhead (9); ii) an inner core (11) protected by said exterior layer (6). The inner core (11) comprises: ii.a) an insensitive munition (IM); ii.b) a polymeric, plastic and/or rubbery matrix embedding the insensitive munition (IM); ii.c) explosive material (5) enclosed within the matrix of ii.b) and/or surrounding the matrix of ii.b). The ratio of the thickness of the protective exterior layer (6) to the radius of the fragmentation device (10) ranges from 0.1:1 to 0.7:1. The warhead (9) is accommodated within the protective exterior layer (6) or between the inner core (11) and the protective exterior layer (6). The invention also relates to a method of firing a fragmentation device (10) as disclosed herein, wherein a firearm is aimed at a surface enabling rebounding of the fragmentation device (10) whereby the fragmentation device (10) changes direc-
(Continued)

tion. The invention also relates to the use of a fragmentation device (10) as disclosed herein in a firearm.

12 Claims, 3 Drawing Sheets

(51) Int. Cl.
*F42B 12/76* (2006.01)
*F42C 19/08* (2006.01)

(58) Field of Classification Search
USPC ..... 102/496, 498, 487, 481, 367, 368, 370, 102/495
See application file for complete search history.

(56) References Cited

U.S. PATENT DOCUMENTS

| | | | | |
|---|---|---|---|---|
| 8,381,657 | B1 * | 2/2013 | Hooke | F42B 39/20 102/487 |
| 8,887,640 | B1 * | 11/2014 | Knight | F42C 11/008 102/210 |
| 9,234,730 | B1 * | 1/2016 | Cook | F42C 13/08 |
| 9,243,876 | B1 | 1/2016 | Botthof et al. | |
| 9,528,801 | B1 * | 12/2016 | Gold | F42B 12/32 |
| 10,088,288 | B1 * | 10/2018 | Caska | F42C 14/025 |
| 11,187,508 | B2 * | 11/2021 | Thuman | F42B 12/32 |
| 2012/0279411 | A1 | 11/2012 | Daoud et al. | |

FOREIGN PATENT DOCUMENTS

| | | | |
|---|---|---|---|
| RU | 2135941 | C1 | 8/1999 |
| WO | WO 2016/100594 | A1 | 6/2016 |

OTHER PUBLICATIONS

International Preliminary Examining Authority, International Preliminary Report on Patentability Chapter II, including Applicant's response to ISA's Apr. 29, 2020 Written Opinion, received for International Application No. PCT/SE2020/050231, dated Feb. 10, 2021, 12 pages, Swedish Patent and Registration Office, Sweden.
International Searching Authority (ISA), International Search Report and Written Opinion received for International Application No. PCT/SE2020/050231, dated Apr. 29, 2020, 14 pages, Swedish Patent and Registration Office, Sweden.
European Patent Office, Extended European Search Report received for Application No. 20772930.2, dated Nov. 18, 2022, 8 pages, Germany.

* cited by examiner

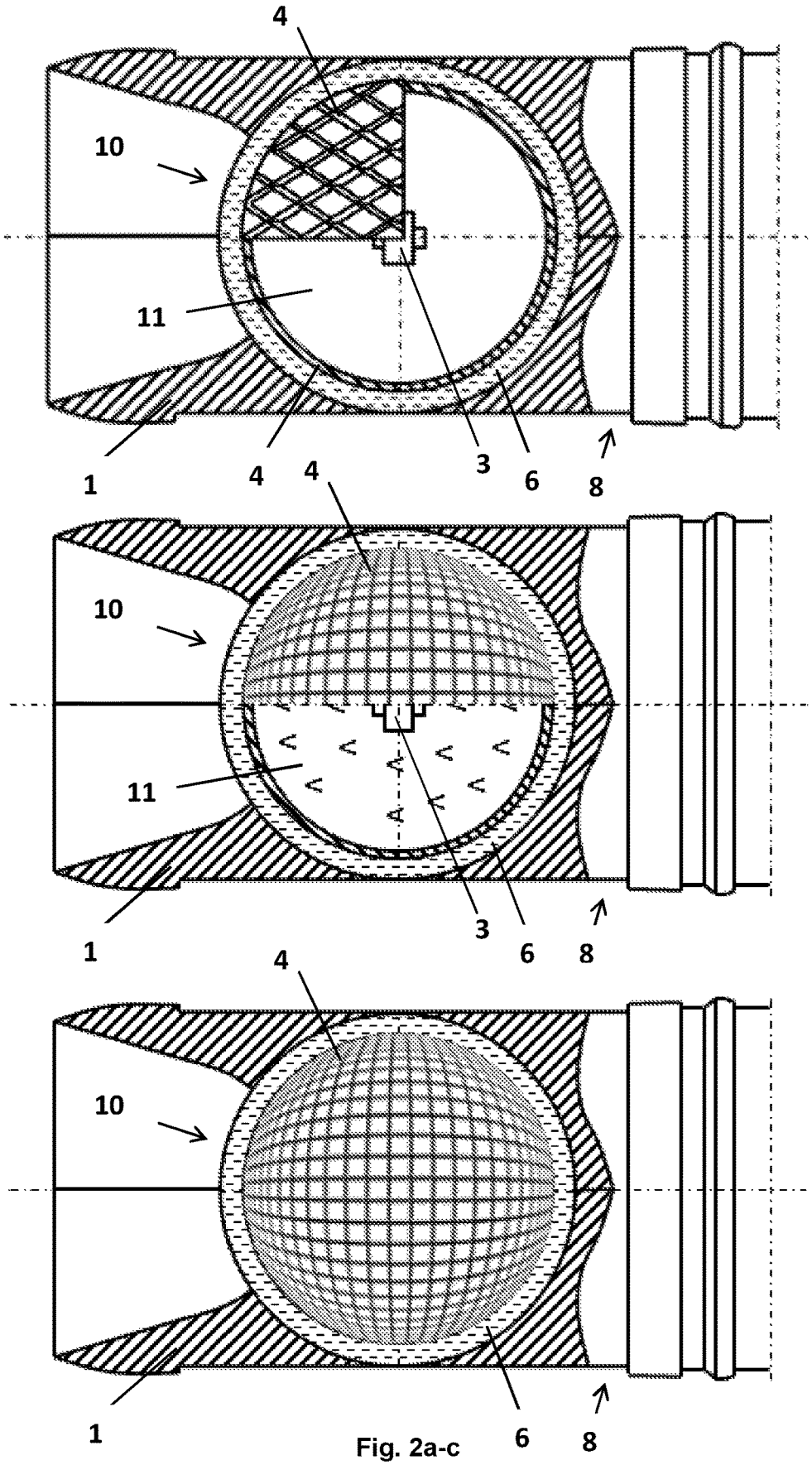
Fig. 2a-c

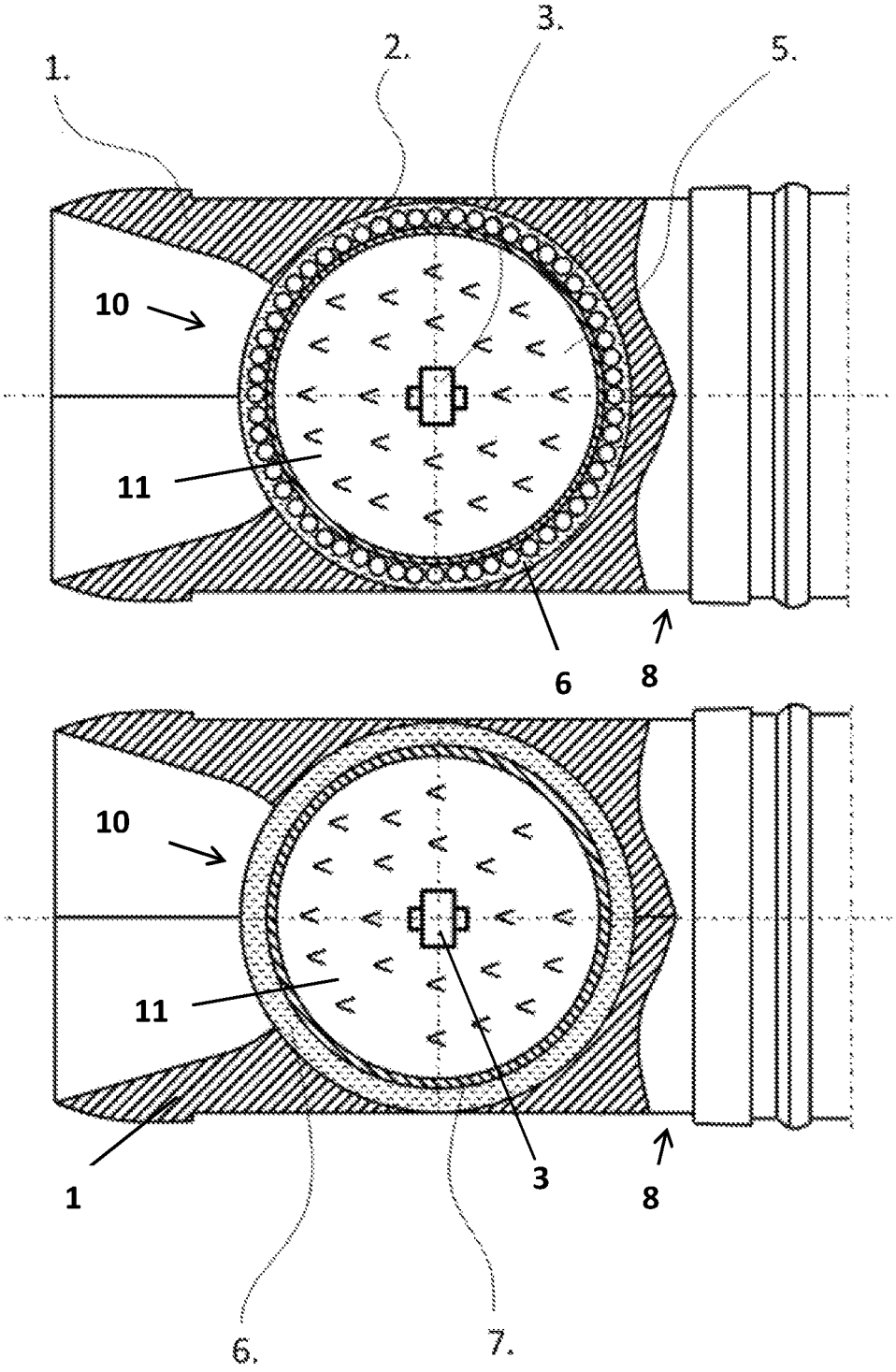
Fig. 3a-b

FRAGMENTATION DEVICE AND METHOD FIRING SUCH A DEVICE

The present invention relates to a fragmentation device, a method of firing a fragmentation device, and the use thereof.

CROSS REFERENCE TO RELATED APPLICATIONS

This application is a National Stage Application, filed under 35 U.S.C. § 371, of International Application No. PCT/SE2020/050231, filed Mar. 2, 2020, which claims priority to Sweden Application No. 1900056-1, filed Mar. 21, 2019; the contents of both of which are hereby incorporated by reference in their entirety.

BACKGROUND

Related Field

Description of Related Art

Fragmentation devices such as hand grenades used in urban combats where a line of sight is needed are well known in the art. Such devices must have a sufficient range to reach the intended target. Also, user safety must be provided for. Attempts to provide hand grenades are described in U.S. Pat. No. 4,942,820. The devices disclosed therein typically include a munition core surrounded by a mesh of thin detonation wires in electrical communication with a detonator. Spokes radiating outwardly are incorporated into a rubberized shell surrounding the munition core. However, the hand grenade provided can only be used for short range targets since it is not fired from a firearm. This implies also a limited precision due to the lack of sight units. The design also imparts very limited target effects since the number of splinter elements is limited and the splinter as such is narrow and light which reduce the speed thereof considerably in the air. Also, the core of the hand grenade allows only for a limited volume of explosives. The manual setting of the ignition function of the device further results in difficult handling, more time consumption and risk of misalignment, especially at low temperatures. Moreover, the hand grenade being dropped by mistake renders the use thereof riskful.

An objective of the present invention is to provide a fragmentation device, especially a shell, enabling use in urban combat environments in which a line of sight between the user and the target is unavailable. A further object of the invention is to provide a fragmentation device which can be fired and subsequently rebound off a surface such as a wall to eventually impact on a target out of sight. The invention further intends to solve the drawbacks of the prior art as described herein.

BRIEF SUMMARY

The present invention relates to a substantially spheroidal fragmentation device accommodating at least one warhead, wherein the fragmentation device comprising i) a protective exterior layer of resilient material ii) an inner core protected by said exterior layer, the inner core comprising ii.a) an insensitive munition (IM)

ii.b) a polymeric, plastic and/or rubbery matrix embedding the insensitive munition (IM)

ii.c) explosive material within the matrix of ii.b) and/or surrounding the matrix of ii.b)

wherein the ratio of the thickness of the protective exterior layer to the radius of the fragmentation device ranges from 0.1:1 to 0.7:1, and wherein the warhead is accommodated within the protective exterior layer or between the protective exterior layer and the inner core.

According to an example, the fragmentation device is configured to be fired from a firearm. According to one embodiment, the fragmentation device is a shell. According to one embodiment, the fragmentation device is substantially sphere-shaped. According to one embodiment, explosive material surrounding the matrix described in ii.b) may be disposed in an outer matrix surrounding the matrix of ii.b). Explosive material may thus be present either in the matrix in which insensitive munition is embedded, in an outer matrix surrounding the matrix in which the insensitive munition is embedded, or in both matrices.

The term "spheroidal" as used herein is meant to include substantially sphere-shaped as well as ellipsoidal shapes of the fragmentation device.

Preferably, the insensitive munition is bound in a plastic matrix in the inner core of the fragmentation device. The explosive material of the insensitive munition may for example be embedded in the matrix by means of casting.

By the term "protective exterior layer of resilient material" as used in the present application, is meant any layer of elastic material that may rebound on a substantially inelastic surface such as a wall or the ground without damaging the fragmentation device or trigger the device to prematurely detonate.

By the term "heavy metal particle" is meant a metal particle having a density of at least 3 g/cm$^3$, preferably at least 7 g/cm$^3$, or at least 10 g/cm$^3$.

According to one embodiment, the resilient material is selected from plastics, polymers and/or rubber. According to one embodiment, the ratio of the thickness of the protective exterior layer to the radius of the fragmentation device ranges from 0:2:1 to 0.6:1, preferably from 0.25:1 to 0.4:1. According to one embodiment, said at least one warhead comprises heavy metal particles. According to one embodiment, the heavy metal particles are embedded uniformly in the exterior layer or disposed in a fragmented metal sphere such as a steel sphere, e.g. in the exterior layer or between the exterior layer and the inner core. According to one embodiment, an SAI unit (Safety, Arming, Initiation) is integrated with a fuze system. This in order to prevent unintentional detonation of any explosive. According to one embodiment, the heavy metal particles have an average diameter ranging from 1 to 10 mm, for example 2 to 7 mm such as from 3 to 4 mm. According to one embodiment, a casing or matrix accommodates heavy metal particles in the exterior layer. The heavy metal particles may also be disposed in a fragmented metal sphere, e.g. a pre-fragmented metal sphere, such as a steel sphere which may be arranged in the exterior layer or between the exterior layer and the inner core. According to one embodiment, the casing or matrix for the heavy metal particles is pre-fragmented. According to one embodiment, a battery activating a fuze system is arranged in the inner core of the fragmentation device. According to one embodiment, a piezoelectric sensor is connected to the fuze system. According to one embodiment, a delay unit is connected to the fuze system.

The invention also relates to a method of firing a fragmentation device as disclosed herein, wherein a firearm is aimed at a surface enabling rebounding of the fragmentation device whereby the fragmentation device changes direction.

The invention also relates to the use of a fragmentation device as disclosed herein in a firearm.

In particular, the method relates to firing of the fragmentation device which subsequently rebounds off a surface such as a wall to eventually detonate, e.g. upon impact on a target out of sight.

According to one embodiment, arming of the fragmentation device is performed subsequent to firing.

According to one embodiment, the heavy metal particles may for example be glued to, cast, or simply embedded in the exterior layer.

According to one embodiment, the fragmentation device has a diameter ranging from 30 to 150 mm, preferably from 35 to 110 mm, and most preferably from 40 to 65 mm.

According to one embodiment, the fragmentation device when loaded in a gun barrel is disposed in a casing corresponding to the diameter of the barrel. According to one embodiment, the fragmentation device is loaded in conjunction with a sabot disposed in the barrel of a firearm.

According to one embodiment, the heavy metal particles are integrated in a matrix of the resilient material in the exterior layer.

According to one embodiment, the heavy metal particles are arranged in a casing, e.g. a metallic casing incorporated in the exterior layer or between the exterior layer and the inner core.

According to one embodiment, the heavy metal particles are embedded in a polymeric, plastic and/or rubber matrix in the exterior layer.

According to one embodiment, the heavy metal particles are sintered in a metal matrix such as a steel matrix in the exterior layer.

According to one embodiment, the heavy metal particles are embedded in fragmented matrix, e.g. a pre-fragmented matrix. Fragmentation may be provided at any portion around the heavy metal particles, for example inside and/or outside the heavy metal particle seen from the inner core of the device.

According to one embodiment, the particles are substantially spherical but may also take any other shape, e.g. irregular shapes such as flakes, cubes, rods, or combinations thereof.

Depending on the use of the fragmentation device, the number of heavy metal particles may differ. According to one embodiment, the number of heavy metal particles ranges from 100 to 400, more preferably from 150 to 300, and most preferably from 210 to 230. According to one embodiment, the number of heavy metal particles ranges from 150 to 1600 particles, preferably from 600 to 900 particles.

According to one embodiment, the inner core of the fragmentation device has a diameter ranging from 20 to 70 mm, preferably from 30 to 50 mm.

According to one embodiment, the exterior layer has a thickness of at least 25%, preferably at least 30%, and most preferably at least 35% based on the radius of the fragmentation device. Preferably, the thickness is at most 40% or at most 50% based on the radius of the fragmentation device.

According to one embodiment, the resilient material of the exterior layer is composed of polyurethane, rubber or the like showing similar resilient properties, or mixtures thereof.

According to one embodiment, the weight of the fragmentation device is in the range from 40 to 420, preferably from 90 to 300, and most preferably from 160 to 250 g. According to one embodiment, the weight of the fragmentation device is 250 to 420 gram.

According to one embodiment, the diameter of the fragmentation device is 50 to 60 mm.

According to one embodiment, the fragmentation device is designed to allow for muzzle velocities e.g. in the range from 70 to 90 m/s. According to one embodiment, the firearm for firing the fragmentation device has a weight ranging from 6 to 8 kg.

According to one embodiment, the coefficient of restitution as the fragmentation device rebounds on a surface ranges from 0.2 to 1.2, more preferably from 0.4 to 1.1, and most preferably from 0.75 to 0.95. By "surface for rebounding" is meant a substantially inelastic surface such as a wall.

According to one embodiment, the coefficient of friction as the fragmentation device rebounds on a surface ranges from 0.2 to 1.0, more preferably from 0.4 to 0.95, and most preferably from 0.6 to 0.9.

According to one embodiment, the coefficient of rolling resistance of the fragmentation device as it rebounds on a surface ranges from 0.015 to 0.6, more preferably from 0.12 to 0.47, and most preferably from 0.25 to 0.6.

According to one embodiment, the heavy particles constituting the warhead are disposed at a distance of at least 4 mm, preferably at least 3 mm from the surface of the exterior layer of the fragmentation device.

According to one embodiment, the exterior layer of the fragmentation device is manufactured by injection molding. As an example, two equal halves, together forming the exterior layer of the fragmentation device, each of the halves having the shape of a hollow hemisphere, are formed in a mold. The halves are then sealed around the inner core of the fragmentation device.

According to one embodiment, a fuze system is incorporated in the core of the fragmentation device. Preferably, the fragmentation device is rotation-stabilized or fin-stabilized. Alternatively, the fragmentation device is non-stabilized.

According to one embodiment, a fuze system is provided with safety means which provides for arming on condition that a predetermined rotational speed is attained subsequent to firing. According to one embodiment, a time-delaying safety device is provided safeguarding detonation is prevented until impact on a target. According to one embodiment, a battery is provided activating the electronics of the fuze system upon impact on the target. The time delay of the fuze may be programmed manually, e.g. by monitoring programming in a sight display.

According to one embodiment, an initiator is disposed in the inner core. The initiator may be initiated by the fuze system subsequent to arming of the fuze system. Preferably, an explosive which may encase the initiator is arranged centrally in the inner core of the fragmentation device. The explosive can be selected from e.g. a PBX composition which may comprise e.g. octanitrocubane. The explosive is preferably bound to a matrix such as a plastics matrix. According to one embodiment, the initiator may comprise azide-based explosives such as zirconium potassium perchlorate (ZPP) and derivatives thereof, thermites, cis-bis-(5-nitrotetrazolato), tetramine cobalt (III) perchlorate), nitro-cobalt-Ill-perchlorate or combinations thereof.

According to one embodiment, the main explosive is a plastic-bonded explosive. A PBX composition generally contains an energetic fuel or "oxidizer" homogeneously dispersed in a matrix of a synthetic thermoset or thermoplastic polymer commonly referred to as a "binder matrix". In this form, the PBX is a high output explosive and may be formulated to exhibit insensitive munition (IM) properties. Conventional PBXs typically comprise oxidizers such as HMX (or "high melting point explosive"), chemically known as cyclotetramethylene tetranitramine, RDX (or-"royal demolition explosive"), chemically known as cyclotrimethylene trinitramine, C1-20, chemically known as 2,4,6,8,10,12-hexanitro-2,4,6,8,10,12-hexaazaisowurtzitane, TATB, chemically known as triaminotrinitrobenzene, FOX-7, also known as 1,1-diamino-2,2-dinitroethene (DADNE), or combinations thereof. According to a preferred embodiment, the main explosive is a PBX composition having an oxidizer comprising octanitrocubane (ONC) dispersed within a binder matrix.

According to one embodiment, a secondary explosive or booster charge is comprised which may encase the initiator. According to one embodiment, the booster charge is encased by a main explosive having IM (Insensitive Munition) properties. Preferably, the booster charge is selected from PBXN-5, PBXN-7, PBXN-9 or combinations thereof. Initiators, booster charges, and main explosive may further be selected from any suitable species as disclosed in US2012/0279411.

According to one embodiment, the fragmentation device is fired at a muzzle velocity ranging from 25 to 200, preferably from 50 to 150 m/s. According to one embodiment, the fragmentation device is fired to reach an acceleration ranging from 900 to 1100 g as it passes the muzzle of the weapon. According to one embodiment, the fragmentation device is fired at a rotational speed of 5000 to 10000, preferably 5500 to 6500 rpm. According to one embodiment, the fragmentation device is fired from a firearm such that the impact angle is in the range of 15 to 60 degrees, preferably from 30 to 45 degrees.

As a fragmentation device is fired from a gun barrel on a wall, it will rebound off due to the resilient properties of the exterior layer. The kinetic energy of the fragmentation device will partly be converted to heat and rotational energy. As the fragmentation device impacts on a wall, it will glide on the surface of the wall at a certain friction force. The friction force will reduce the translational velocity along the wall but the rotational velocity will increase. Subsequently, if the contact time to the wall is sufficiently long, the fragmentation device will instead of gliding start to roll along the wall.

BRIEF DESCRIPTION OF THE FIGURES

FIGS. 2*a-c* show a pre-fragmented steel sphere at which heavy metal particles are to be disposed.

FIG. 3*a* shows an embodiment in which the heavy metal particles are embedded in the exterior layer. FIG. 3*b* shows heavy metal particles arranged in a pre-fragmented steel sphere.

DETAILED DESCRIPTION OF VARIOUS EMBODIMENTS

Figures 1A, 1B, 1C:
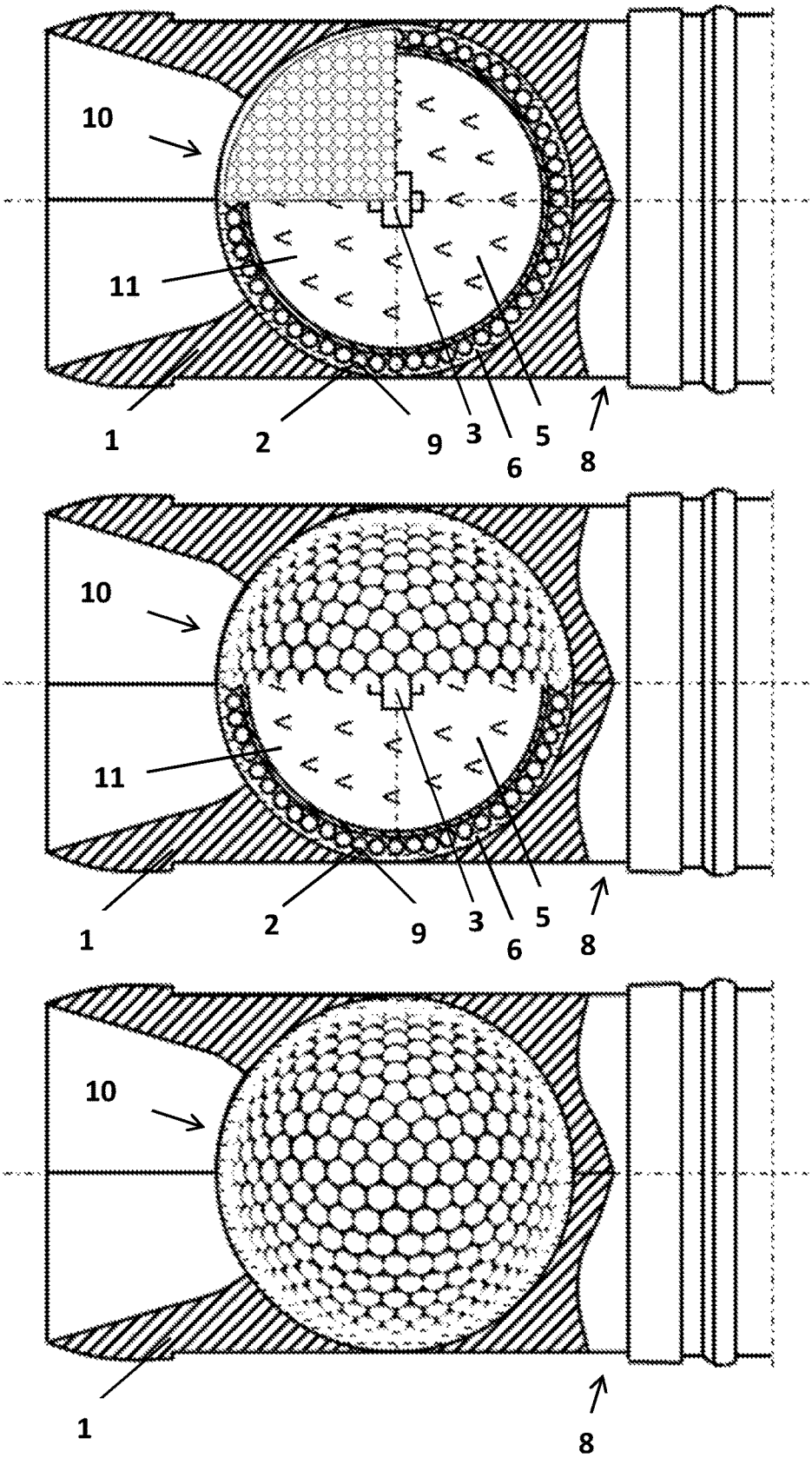
FIGS. 1*a-c* show the shape of a fragmentation device illustrating heavy metal particles embedded in the exterior layer of the fragmentation device in different extents so as to simultaneously show the inner core of the fragmentation device.

FIG. 1*a* shows a fragmentation device 10 disposed in a sabot 1 in a barrel 8. The fragmentation device 10 is a substantially spheroidal fragmentation device 10. The fragmentation device 10 accommodates at least one warhead 9. The fragmentation device 10 comprises a protective exterior layer 6 of resilient material and an inner core 11 protected by said exterior layer 6.

In FIGS. 1*a-b* (the uppermost figures), explosives 5 may be seen in the inner core 11 of the fragmentation device 10. An SAI unit 3 is arranged in the central portion of the inner core 11. According to the example shown in FIG. 1*a*, the at least one warhead 9 comprises heavy metal particles 2. The heavy metal particles 2 are embedded in a rubber matrix comprised in the protective exterior layer 6. FIGS. 1*b-c* show the same embodiments as in FIG. 1*a* illustrating the heavy metal particles 2 embedded in the rubber matrix of the fragmentation device 10.

FIGS. 2*a-c* show embodiments with a pre-fragmented steel sphere 4 in which heavy metal particles 2 are disposed (not shown). The sphere 4 is disposed between the exterior layer 6 and the inner core 11. The further numerals are identical to those of FIG. 1*a*.

FIG. 3*a* shows heavy metal particles 2 embedded in the protective exterior layer 6. FIG. 3*b* shows heavy metal particles 2 (not shown) disposed in a pre-fragmented steel sphere 7 inside the protective exterior layer 6 but outside the inner core 11. The further numerals are identical to those of FIG. 1*a*.

The invention claimed is:

1. A substantially spheroidal fragmentation device (10) configured to be fired from a firearm, the fragmentation device (10) accommodating at least one warhead (9), the fragmentation device comprising i) a protective exterior layer (6) of resilient material ii) an inner core (11) protected by said exterior layer (6), the inner core (11) comprising ii.a) an insensitive munition (IM)

ii.b) a polymeric, plastic and/or rubbery matrix embedding the insensitive munition (IM)

ii.c) explosive material (5) enclosed within the matrix of ii.b) and/or surrounding the matrix of ii.b)

wherein the ratio of the thickness of the protective exterior layer (6) to the radius of the fragmentation device (10) ranges from 0.25:1 to 0.4:1, and wherein the warhead (9) is accommodated within the protective exterior layer (6) or between the inner core (11) and the protective exterior layer (6).

2. The fragmentation device (10) according to claim 1, wherein the fragmentation device (10) is a shell.

3. The fragmentation device (10) according to claim 1, wherein the fragmentation device (10) is substantially sphere-shaped.

4. The fragmentation device according to claim 1, wherein the resilient material is selected from plastics, polymers and/or rubber.

5. The fragmentation device according to claim 1, wherein said at least one warhead (9) comprises heavy metal particles (2).

6. The fragmentation device according to claim 5, wherein the heavy metal particles (2) are i) embedded uniformly or disposed in a fragmented metal sphere (7) in the exterior layer (6); or ii) disposed in a fragmented metal sphere (4) between the exterior layer (6) and the inner core (11).

7. The fragmentation device according to claim 1, wherein an SAI (Safety/Arming/Initiation) unit (3) is integrated with a fuze system.

8. The fragmentation device according to claim 5, wherein the heavy metal particles (2) have an average diameter ranging from 3 to 4 mm.

9. The fragmentation device (10) according to claim 7, wherein a battery activating the fuze system is arranged in the inner core (11) of the fragmentation device (10).

10. The fragmentation device (10) according to claim 7, wherein a piezoelectric sensor is connected to the fuze system.

11. The fragmentation device (10) according to claim 7, wherein a delay unit is connected to the fuze system.

12. Method of firing a fragmentation device (10) according to claim 1, wherein a firearm is aimed and the fragmentation device (10) is fired at a surface enabling rebounding of the fragmentation device (10) whereby the fragmentation device (10) changes direction.

* * * * *